US005379897A

United States Patent [19]

Muckenfuhs et al.

[11] Patent Number: 5,379,897

[45] Date of Patent: Jan. 10, 1995

[54] DISPOSABLE, COMPACTABLE, SHAPE-RESTORABLE PACKAGES FOR STORING AND DISPENSING DRY OR PREMOISTENED SHEETS

[75] Inventors: Delmar R. Muckenfuhs, Middletown; Charles J. Berg, Jr., Cincinnati; Mark D. Young, West Chester, all of Ohio

[73] Assignee: The Procter & Gamble Company, Cincinnati, Ohio

[21] Appl. No.: 156,513

[22] Filed: Nov. 23, 1993

Related U.S. Application Data

[63] Continuation of Ser. No. 916,817, Jul. 20, 1992, abandoned.

[51] Int. Cl.[6] ..... B65D 81/24; A47K 10/24

[52] U.S. Cl. ..... 206/494; 206/233; 206/812; 220/666; 221/45; 221/64

[58] Field of Search ..... 206/494, 233, 449, 812, 206/205, 210; 221/45, 47–51, 63–65; 220/666, 667, 8

[56] References Cited

U.S. PATENT DOCUMENTS 2,573,309 10/1951 Chipkevich .

(List continued on next page.)

FOREIGN PATENT DOCUMENTS

| | | | |
|---|---|---|---|
| 862791 | 7/1978 | Belgium . | |
| 0030348 | 6/1981 | European Pat. Off. . | |
| 0126362 | 11/1984 | European Pat. Off. | 206/233 |
| 0225865 | 6/1987 | European Pat. Off. . | |
| 0253308 | 1/1988 | European Pat. Off. | 221/50 |
| 0352534 | 1/1990 | European Pat. Off. | 206/494 |
| 0501260 | 9/1992 | European Pat. Off. . | |
| 0501260A1 | 9/1992 | European Pat. Off. . | |
| 2376802 | 8/1978 | France . | |
| 3700988 | 7/1988 | Germany . | |
| 6801925 | 8/1969 | Netherlands | 206/494 |

OTHER PUBLICATIONS

Photos of a Spiffits glass cleaner. This package was bought in a Cincinnati, Ohio grocery store in 1992. Photos numbered 1 to 7 illustrate the condition of the package prior to compressive loading, while photos numbered 8 to 11 illustrate the condition of the package after its top and bottom surfaces have been subjected to compressive loading.

*Primary Examiner*—Bryon P. Gehman

*Attorney, Agent, or Firm*—E. Kelly Linman; John M. Howell; Ronald W. Kock

[57] ABSTRACT

A disposable, compactable package for reliably dispensing a stack of sheet products even after the package has been deformed or compacted. The package comprises a top wall and a bottom wall comprised of a resiliently deformable material. The top and bottom walls are spaced from and oriented generally parallel to one another. They are connected to one another about their peripheries by means of a thinner more easily deformable substantially continuous tube or hoop which is also comprised of resiliently deformable material. The substantially continuous tube or hoop, which is preferably integrally formed with either the top wall, defines the side walls of the package. The tube, which may be of any desired cross-sectional shape, is also produced from material having a sufficient resilient memory that it easily and resiliently deforms when the external force is applied to the package, yet by virtue of its tubular configuration and its resilient memory exhibits a strong tendency to self-restore once the external applied force is removed. The package, which is preferably rectangular, includes a preformed dispensing aperture or means for providing a dispensing aperture in its top or its bottom wall. The dispensing aperture is smaller than the cross-sectional profile, i.e., the cross-sectional "footprint", of the sheet products contained within the stack to retain the sheet products inside the package throughout the package's useful life. The sheet products may be in discrete or continuous form.

3 Claims, 3 Drawing Sheets

U.S. PATENT DOCUMENTS 3,197,062 7/1965 Day et al. ..... 221/48
3,306,492 2/1967 Kugler .
3,319,684 5/1967 Calhoun ..... 220/666 X
3,819,043 6/1974 Harrison ..... 206/449
4,131,195 12/1978 Worrell, Sr. .
4,185,754 1/1980 Julius .
4,411,374 10/1983 Hotchkiss .
4,420,080 12/1983 Nakamura ..... 206/449
4,487,318 12/1984 Roen .
4,540,091 9/1985 Habock .
4,735,317 4/1988 Sussman et al. .
4,790,436 12/1988 Nakamura .
4,833,862 5/1989 Bortolani et al. .
4,863,064 9/1989 Dailey, III .
4,930,644 6/1990 Robbins, III ..... 220/8 X
4,979,613 12/1990 McLaughlin et al. .
5,048,718 9/1991 Nakamura .
5,050,737 9/1991 Joslyn et al. .
5,076,436 12/1991 Bortolani et al. .
5,201,164 4/1993 Kaufman .

DISPOSABLE, COMPACTABLE, SHAPE-RESTORABLE PACKAGES FOR STORING AND DISPENSING DRY OR PREMOISTENED SHEETS

This is a continuation of application Ser. No. 07/916,817, filed on Jul. 20, 1992 now abandoned.

DESCRIPTION OF THE PRIOR ART

In the prior art of dry and premoistened sheet product packaging, two general forms of packages have been employed; flexible overwrap packaging and substantially rigid containers. Each package type has unique advantages.

A conventional overwrap package is produced from flexible sheet materials and exhibits the advantages of being (i) easily compactable for efficient storage (e.g., purse, glove compartment, drawer) and (ii) relatively low in material cost. However, the flexible overwrap package's principal disadvantage is that it simply collapses as product is removed from the package, i.e., it is typically non-resilient. Thus, near the end of the flexible overwrap package's useful life it offers little or no structural integrity protection to the remaining product and oftentimes, due to its lack of form and difficulty of dispensing, may be discarded prior to complete emptying of its contents.

By way of contrast a conventional substantially rigid package is made from more rigid materials such as cardboard, paperboard, carton board, stiff plastic, etc. Such substantially rigid packages offer the advantages of (i) protecting the product from crushing by resisting deformation, at least up to a point; and (ii) providing the user with a package which can be conveniently and reliably gripped to provide anchoring during dispensing without fear of inadvertently gripping the product sheets inside the package through the walls of the package. Unfortunately, substantially rigid packages of the aforementioned type are not readily compactable to facilitate easy, unobtrusive, temporary storage, such as in a purse or in the pocket of an article of wearing apparel. Furthermore, such substantially rigid packages will resist deformation only up to a predetermined point. Once that point is exceeded, such packages are permanently deformed or damaged or take on a permanent set. Accordingly, they do not exhibit any appreciable tendency to self-restore to their substantially original shape once the deforming force is removed. Thus, for packages used to dispense sheet products having a cross-sectional "footprint" bigger than the dispensing aperture in one or more of the package's walls, initial deformation of the package may destroy the package's ability to reliably dispense the sheet products housed inside in one-at-a-time fashion.

OBJECTS OF THE INVENTION

Accordingly, it is an object of this invention to provide a sheet dispensing package which is easily deformable or compactable but which exhibits a strong tendency to self-restore to its substantially original shape once the deforming or compacting force is removed.

It is a further object to provide such a package which is suitable for reliably dispensing dry or premoistened sheet products in one-at-a-time fashion even after many deformation cycles of the package.

It is a still further object to provide method and apparatus for producing such packages.

DISCLOSURE OF THE INVENTION

Resiliently deformable packages of the present invention provide the user not only with product protection, but with temporary compactability wherein the compacted package tends to self-restore to near its original shape for easy and reliable one-at-a-time dispensing of the sheet products contained therein. In a particularly preferred embodiment the package comprises a relatively thicker and stiffer top and bottom wall comprised of a resiliently deformable material and oriented generally parallel to one another. The top and bottom walls are preferably connected to one another about their peripheries by means of a thinner, more easily deformable substantially continuous tube or hoop, which is preferably comprised of the same resilient material as the bottom wall, the top wall or both. The tube or hoop may be of nearly any desired cross-section, but is typically rectangular. A dispensing aperture is provided in either the top wall or the bottom wall to permit one-at-a-time dispensing from the stack of sheet products contained within the package. The sheet products have a cross-sectional "footprint" bigger than the dispensing aperture to retain the sheet products within the package throughout the package's useful life.

Resiliently deformable packages of the present invention can be made from low cost materials, are easy to produce and fill and can undergo numerous deformation cycles between successive sheet dispensing operations without impairing the package's ability to facilitate reliable one-at-a-time dispensing of the sheet products contained therein.

BRIEF DESCRIPTION OF THE DRAWINGS

While the specification concludes with claims that particularly point out and distinctly claim the subject matter regarded as forming the present invention, it is believed that the present invention will be better understood from the following detailed description with reference to the drawings in which:

DETAILED DESCRIPTION OF THE PREFERRED EMBODIMENTS

Figure 1:
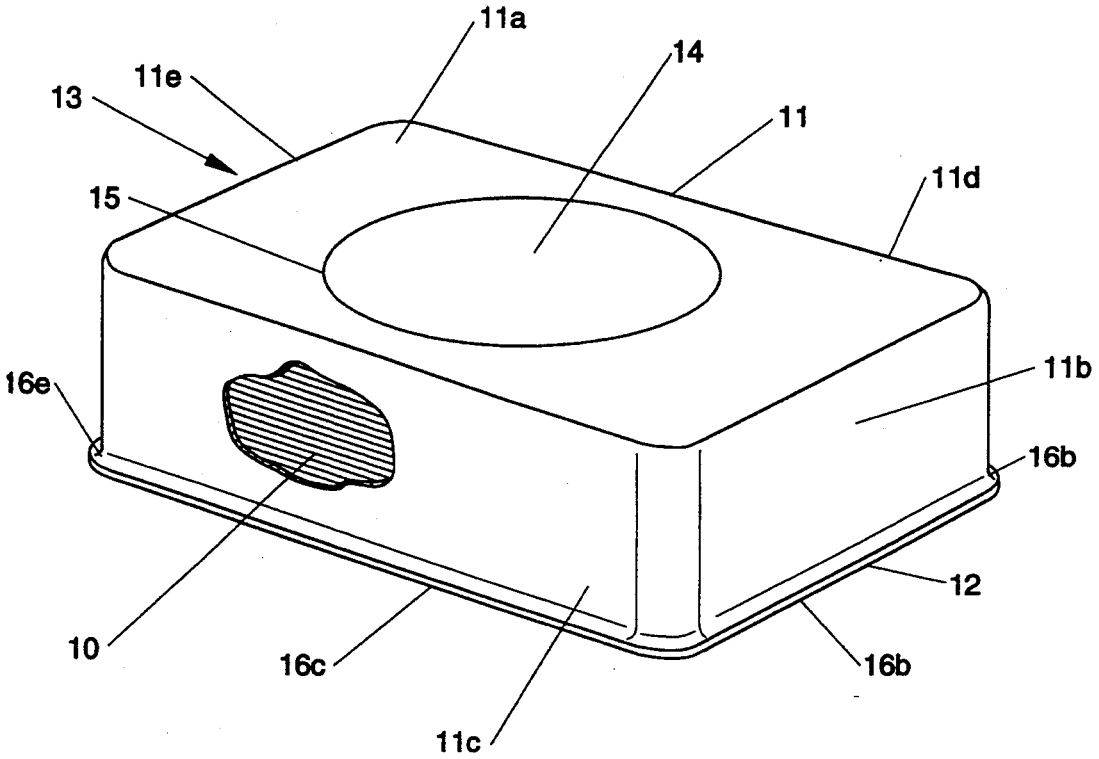
FIG. 1 is a simplified perspective illustration of a resiliently deformable package of the present invention shown prior to initial opening.
Figure 5:
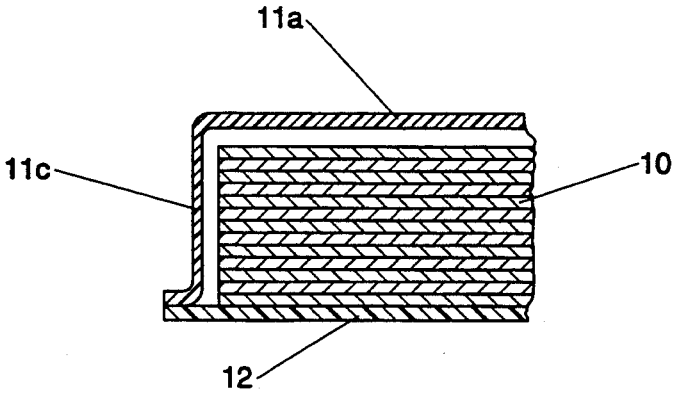
FIG. 5 is a partial sectioned elevational view of the package shown in FIG. 1, showing the relative thicknesses of top wall 11*a*, side wall 11*c*, and bottom wall 12.

Referring to FIG. 1, there is shown a preferred package 13 of the present invention as manufactured for use with a stack of sheet products 10, such as folded paper towels or folded facial tissues, which can normally be deformed without being damaged. A stack of the sheet products 10 is contained within a thermoformed container 11 which is sealed to the bottom wall 12. Bottom wall 12 of package 13 comprises a flat sheet material relatively thicker than the intersecting side walls 11*b*, 11*c*, 11*d* and 11*e* of the container 11. The top wall 11*a* of the thermoformed container 11 includes an area 14 bounded by a line of weakness (e.g., perforations, score lines, etc.) having a perimeter 15 which allows the user to partially or completely remove the area 14 from the top wall 11*a* to create an aperture for dispensing the sheet products 10 in one-at-a-time fashion. The dispensing aperture formed by separation of area 14 along line of weakness 15 is smaller than the cross-sectional "footprint" of the sheet products 10 contained within the stack. This helps retain the sheet products 10 within the package 13 throughout the package's useful life. If desired, line of weakness 15 may expand into one or more of side walls 11*b*, 11*c*, 11*d* or 11*e* to provide improved gripping access to the sheet products 10, by defining a dispensing aperture which will extend at least to a degree into one or more said side walls, said aperture providing a sufficient portion of top wall 11*a* to restrain the stack of sheet products within package 13 once area 14 has been removed to create a dispensing aperture.

The stack contained within package 13 may be comprised of discrete sheet products or, if desired, the sheet products can be continuously connected to one another and separated from one another by the user upon removal from the package. If the sheet products are in continuous form they are preferably frangibly connected to one another. The frangible connection provides the user a convenient means to separate as many sheet products 10 as are desired from the stack for each dispensing cycle. Frangibility can be provided by any of several known means which create a line of weakness, such as perforations, score lines, etc. The user can separate the desired number of sheet products 10 by tearing along the line of weakness either before, during or after it has passed through the package's dispensing aperture.

As with discrete sheet products, the area 14 of the top wall 11*a* which is either partially or completely removed to form a dispensing aperture in top wall 11*a* should be smaller than the cross-sectional "footprint" or surface area of the stack comprising the continuous product in order to restrain the product within the package. The shape and size of the dispensing aperture formed in top wall 11*a* can, if desired, be dimensioned and configured to provide a pop-up effect. Pop-up effect, as used herein, refers to a dispensing operation wherein the leading edge of a second sheet product 10 is exposed beyond the dispensing aperture when a first sheet product 10 is dispensed. This pop-up effect is due to physical interference between the dispensing aperture and the sheet product 10, which prevents the sheet product from falling back into the package 13 due to the force of gravity. The portion of exposed sheet product 10 provides an easy tab for the user to grip and withdraw more sheet products 10 from the package 13 on a subsequent dispensing cycle. Pop-up dispensing can be carried out when the sheet products are either in discrete or continuous form by proper folding thereof.

The continuous form of sheet product can be folded within the package 13 in any desired pattern, a particularly preferred pattern being a continuous Z-folded stack having a cross-sectional "footprint" larger than the dispensing aperture formed in the package's top wall 11*a*. If the product in question comprises frangibly connected sheets, the lines of weakness between adjacent sheet products can be located at any frequency and interval along the length of the continuous product.

Both the container 11 and bottom wall 12 are comprised of resiliently deformable material. The top wall 11*a* of container 11 is preferably thicker than the side walls 11*b*, 11*c*, 11*d* and 11*e*. The bottom wall 12, which is also preferably thicker than the side walls 11*b*, 11*c*, 11*d* and 11*e*, is preferably continuously secured to the container 11 along flanged edges 16*b*, 16*c*, 16*d* and 16*e*, respectively. The bottom wall 12 can be joined to the container 11 by any number of known techniques, including heat sealing, adhesive, etc. If package reusability is desired, bottom wall 12 can be releasably secured to container 11 by releasable securement means, such as a pressure sensitive adhesive, to permit refilling package 13 with sheet products 10 whenever the package has been emptied.

In general, resiliently deformable packages of the present invention may employ greater side wall thicknesses as the resiliency of the material comprising the side walls increases. Conversely, as the resiliency of the materials used to construct the side walls decreases, thinner side wall thicknesses are preferably employed to maximize the resiliently deformable characteristic of packages of the present invention.

In a particularly preferred embodiment of the present invention, the bottom wall 12 and/or the top wall 11 are sufficiently thick that the user can easily grip the bottom and/or top wall of the package 13 by applying compressive forces to their opposed lateral edges during the dispensing operation without significantly deforming the sheet products 10 housed within package 13. This provides easier one-at-a-time dispensing of the sheet products 10 through the dispensing aperture in top wall 11*a*.

Figure 2:
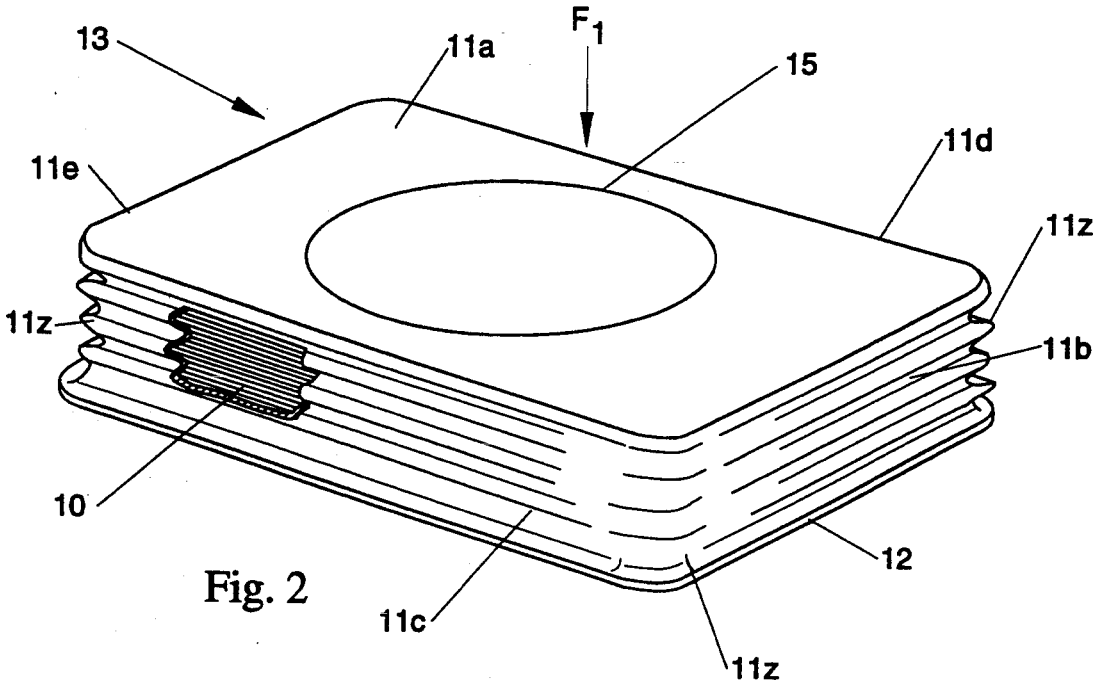
FIG. 2 is a similar view of the package shown in FIG. 1 after a dispensing aperture has been created in its top wall, a number of sheet products have been removed, and a compressive force $F_1$ has been applied to the uppermost surface of the package.

In FIG. 2, an open resiliently deformable package 13 of the type generally disclosed in FIG. 1 is shown only partially filled with sheet products 10. The circumferential attachment of the intersecting side walls 11*b*, 11*c*, 11*d* and 11*e* defines a tube or hoop which is easily deformable by an externally applied force "$F_1$", as shown by the deformed corners 11*z* which are formed by the intersecting side walls 11*b*, 11*c*, 11*d* and 11*e*. This deformation occurs due to the thinness of the side walls and the resiliently deformable characteristic of the material comprising the side walls. When the deforming force "$F_1$" is removed from the top 11*a* of the resiliently deformable package 13 the tube or hoop formed by the interconnected side walls 11*b*, 11*c*, 11*d* and 11*e* tends to cause the container 11 to self-restore toward its substantially that original undeformed shape, as generally shown in FIG. 1, substantially eliminating the folds at the package's corners 11*z*. As used herein, the term "self-restore" refers to the tendency of resiliently deformable package 13 to return toward its original undeformed condition without taking on a permanent set due to the deformation when the deforming forces are removed. This recovery may not fully restore the package to its exact original shape and appearance. However, unlike substantially rigid packages of the prior art, resiliently deformable package 13 will self-restore to a degree which is sufficient to at least facilitate reliable one-at-a-time dispensing of sheet products 10. Furthermore, each subsequent sheet dispensing operation tends to assist the package in resuming its original substantially undeformed condition.

If thermoforming is employed to produce container 11 and/or bottom wall 12 it is also feasible to produce highly decorative effects in the resulting package 13 at relatively low cost, simply by preparing a suitable mold. For example, textures, logos, instructions, etc., can be molded into the container 11 and/or bottom wall 12 to produce a desirable aesthetic appearance and/or integral brand identification and/or usage instructions, all without the need for ancillary printing or labeling operations.

The package 13 shown in FIG. 2 easily compacts until reaching the top of the partial stack of sheet products 10. Accordingly, the excess volume in the package can be eliminated as successive sheets are dispensed, making the package easy to carry and store until the next sheet dispensing cycle.

Twisting forces which may be applied to the package 13 will be resisted not only by the tube or hoop formed by the intersecting side walls 11*b*, 11*c*, 11*d* and 11*e*, but also by the torsional resistance of the substantially planar and thicker top and bottom walls 11*a* and 12, respectively. Accordingly, both the side walls 11*b*, 11*c*, 11*d* and 11*e* and the relatively thicker top and bottom walls 11*a* and 12, respectively, help to restore the package toward substantially its original configuration once all of the externally applied forces have been removed from the package. This permits the resiliently deformable package 13 to facilitate reliable one-at-a-time dispensing of the sheet products 10 from the dispensing aperture in top wall 11*a* even after repeated deformation cycles.

In addition, the manufacturer can produce resiliently deformable package 13 at relatively low cost using a minimum of relatively low cost materials.

While deformability and low cost could previously be found only in conventional overwrap packages and product protection and reliable one-at-a-time sheet dispensing could previously be found only in rigid containers, at least up to the point of crushing, resiliently deformable package 13 of the present invention for the first time combines all of these previously incompatible features within a single structure.

Referring again to FIG. 2, while the top wall 11*a*, the side walls 11*b*, 11*c*, 11*d* and 11*e* and the bottom wall 12 of the resiliently deformable package 13 need not be produced from the same material, there may be certain advantages for doing so. From a manufacturing standpoint, the use of similar materials may make the joining of the top wall 11*a*, the side walls 11*b*, 11*c*, 11*d* and 11*e* and the bottom wall 12 to one another easier and less expensive using known techniques, e.g., heat sealing, ultrasonics, etc. Furthermore, with regard to the recycling of the emptied and discarded package 13, it may be easier if all the elements comprising the package 13 are comprised of the same material, thus eliminating the need to separate components from one another prior to material recovery processing.

If, for any reason, it is desired to store and reliably dispense a premoistened sheet product, whether in discrete or continuous form, in one-at-a-time fashion, e.g., as a moistened towelette, a premoistened baby or menstrual wipe, a premoistened personal hygiene wipe or the like, a package similar to resiliently deformable package 13 of the type generally disclosed in FIG. 1 can be employed, as long as the material used is moisture impervious and as long as the package is provided with a resealable feature to prevent moisture loss through the dispensing aperture between successive dispensing operations. A resiliently deformable package 313 employing such a feature is illustrated in FIG. 3.

Resiliently deformable package 313, which is made from moisture impervious material, comprises all the same elements as package 13 in FIG. 1, with the exception of how a dispensing aperture is provided in top wall 11*a*. Secured in superposed relation over the line of weakness 15 is a tabbed resealable label 346 which fully covers not only area 14 in top wall 11*a*, but also the line of weakness 15. The outermost border 347 of resealable label 346 extends beyond the periphery of line of weakness 15. The central portion of the label 346, which coincides with the removable area 14 in top wall 11*a*, is permanently affixed to the removable area 14 by any of numerous means well known in the art, e.g., heat sealing, adhesive, ultrasonics, etc. The first time that the user opens the resiliently deformable package 313, he or she will grip the unsecured tab 348 on label 346 and peel back the label 346, thereby causing separation of area 14 from top wall 11*a* along line of weakness 15. This peeling action is continued until the separation reaches anchor area 349 where the resealable label 346 is permanently attached to the package's top wall 11*a*. This can be accomplished by any of several means well known in the art, e.g., adhesives, heat sealing, ultrasonics, etc.

During the initial opening, peeling back the label 346 automatically separates area 14 from the top wall 11*a* along line of weakness 15 to provide a sheet dispensing aperture. The removable area 14 remains permanently affixed to the central portion of label 346 throughout the useful life of the package 313. Once a sheet product 10 is removed from the package 313, the user can reclose the dispensing aperture formed along line of weakness 15 by resecuring the resealable portion, i.e., the outermost portion 347 of label 346 which extends beyond area 14 of top wall 11*a*, back to its original position. This resealable portion 347 of label 346 is typically provided with reseal means, such as a pressure sensitive adhesive, a continuous mating groove and boss of the type used on freezer storage bags or the like, to provide a substantially moisture impervious reseal of package 313.

Figure 3:
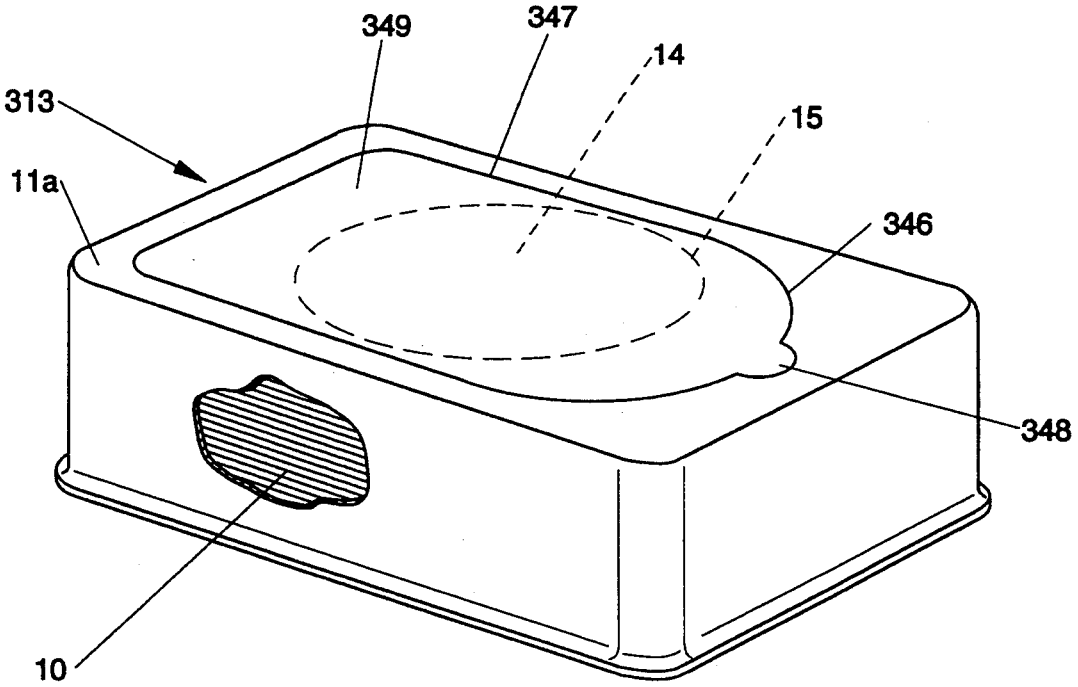
FIG. 3 is a view of a resiliently deformable package of the type generally shown in FIG. 1, but provided with a resealable label which will permit storage and dispensing of premoistened sheet products without dry out between successive dispensing cycles.

FIGS. 4A–4D demonstrate a method for achieving compactness during subsequent sheet product dispensing cycles using a resiliently deformable package 313 of the type generally shown in FIG. 3. This type of dispensing procedure ensures that the package 313 is not much larger than the volume of the remaining sheet products 10 throughout the package's useful life.

Figure 4A:
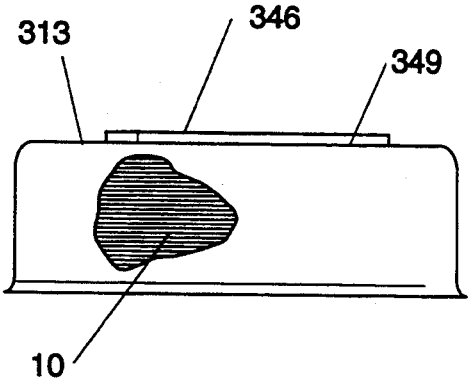
FIG. 4A is a simplified side elevation view which has been partially cut away showing the package of FIG. 3 prior to opening.

FIG. 4A shows the original unopened package 313 complete with a partial cutaway view of the stack of sheet products 10.

Figure 4B:
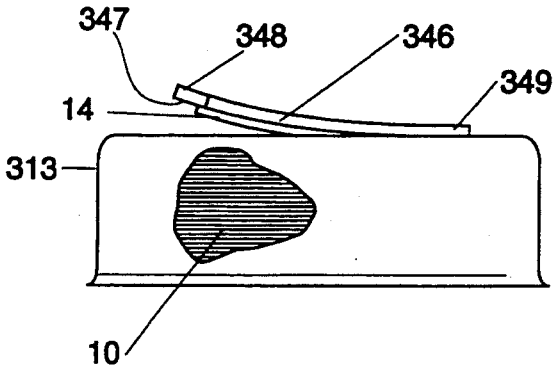
FIG. 4B is a view of the package shown in FIG. 4A after the resealable label of the package has been peeled back and a number of sheet products removed.

FIG. 4B shows the package 313 with resealable portion 347 of label 346 partially peeled back to its open position after the package has been partially emptied of sheet products 10, as can be seen in the partial cutaway view.

Figure 4C:
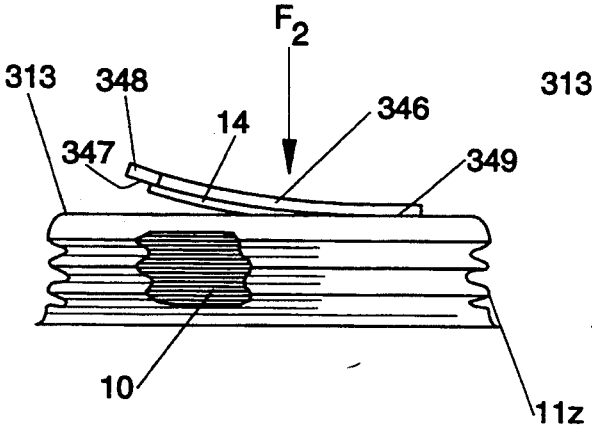
FIG. 4C is a view of the package shown in FIG. 4B when an external compressive force $F_2$ has been applied to its uppermost surface prior to resealing thereof.

FIG. 4C shows the package 313 after it has been partially collapsed by the user by applying an external force $F_2$ onto the top wall 11*a* of the package and consequently onto the remaining sheet products 10. This creates the irregularly shaped corners 11z where the side walls of the package intersect one another.

Figure 4D:
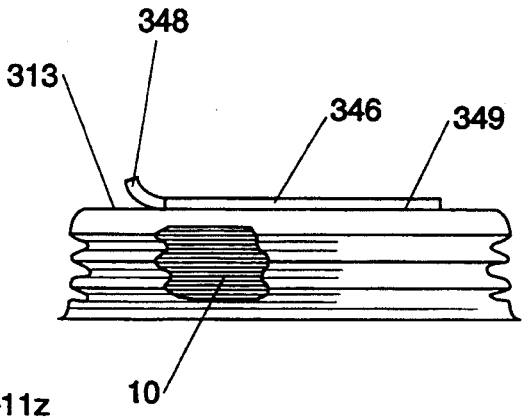
FIG. 4D is a view of the package shown in FIG. 4C after the resealable label has been secured in place to provide a substantial reseal to the atmosphere.

FIG. 4D shows the package 313 with the resealable portion 347 of label 346 returned to its closed position, thereby substantially, resealing the package 313 to the surrounding atmosphere in its partially collapsed or compacted configuration, as generally shown in FIG. 4C. The package 313, which is substantially sealed to the atmosphere, will remain in this partially compacted state, resisting its natural tendency to recover to its original shape, because the reseal portion 347 of label 346 substantially prevents the package from drawing in the atmospheric air which would be necessary for the package to self-restore toward its original substantially undeformed volume. This condition will persist until such time as the package is re-opened by peeling back label 346, at which time the package will tend to return substantially toward the configuration shown in FIG. 4B to facilitate easy and reliable one-at-a-time dispensing of the remaining sheet products 10. It is this same reseal feature which substantially prevents dry out of the unused premoistened sheet products 10 between successive dispensing cycles.

EXEMPLARY EMBODIMENT OF A RESILIENTLY DEFORMABLE PACKAGE OF THE PRESENT INVENTION

In a particularly preferred embodiment of the present invention the following assembly procedure may be employed to construct a resiliently deformable package 13 of the type generally described in connection with FIGS. 1 and 2.

MATERIALS:

Low density polyethylene (LDPE) film such as Resinol, as available from Allied Resinous Products, P.O. Box 620, Clark and Whitney Street, Conneaut, Ohio 44030, can be employed to construct container 11 and bottom wall 12.

Bounty® paper towels, as available in roll form from The Procter & Gamble Company of Cincinnati, Ohio, can be employed to form a stack of discrete sheet products 10 to be dispensed.

EQUIPMENT:

A Vacuum Thermoformer such as a Model R12, as available from AtlasVac Machine Corporation, 4200 Malsbary Road, Dept. A, Cincinnati, Ohio 45242, can be employed to vacuum thermoform container 11.

A Vertrod Impulse Heat Sealer such as Model PC-CAN, as available from Vertrod Corporation, 2307 Utica Avenue, Brooklyn, N.Y. 11234, can be employed to continuously heat seal container 11 and bottom wall 12 to one another about their respective peripheries.

ASSEMBLY PROCEDURE:

A male thermoforming mold can be made from any suitable thermoforming mold material such as wood, aluminum or other such materials known in the art for such purposes. A mold measuring approximately four (4) inches wide by five and five/eighths ($5\frac{5}{8}$) inches long and having a depth of approximately one and five/eights ($1\frac{5}{8}$) inches high with the corners radiused to approximately one/eighth ($\frac{1}{8}$) inch can be used to make container 11.

This mold can be placed in the Atlas R-12 vacuum thermoformer. Using a five (5) mil (0.005 inches) thick sheet of the low density polyethylene film, a container 11 can be formed with about fifteen (15) seconds of preheat time. This process will yield a flanged container 11 of the type generally shown in FIGS. 1 and 2 having a top wall **11*a* of approximately five (5) mils thickness and side walls 11*b*, 11*c*, 11*d* and 11*e* of approximately two to three (2 to 3) mils thickness. This thermoformed polyethylene container 11 can be trimmed about its flanged periphery (leaving about a one half ($\frac{1}{2}$) inch border all the way around the container 11). If any forming webs are produced at the intersecting corners of container 11 during the vacuum thermoforming process, they are preferably removed by severing them with a sharp blade without damaging the corners of the container 11, and a line of weakness 15 comprised of a line of perforations, a heat score line or the like which can be used to provide an elliptical dispensing aperture having a major axis of about four (4) inches oriented parallel to the longest dimension of container 11 and a minor axis of about two (2) inches oriented parallel to the shortest dimension of container 11 in the top wall 11*a* of the container is provided prior to filling the container with a stack of sheet products 10**.

The vacuum thermoformed container 11 is then filled with a stack of suitable sheet products 10, such as Bounty® paper towels as available from The Procter & Gamble Company of Cincinnati, Ohio. The sheet products 10 which measure approximately eleven (11) inches×eleven (11) inches, are preferably individually torn from the Bounty® roll and Z-folded about an imaginary line through their center and parallel to an edge thereof prior to being folded in half. A stack comprised of the thus folded discrete sheet products 10 will fit nicely into a container 11 having the aforementioned dimensions.

A bottom wall also comprised of polyethylene film can thereafter be sealed to the previously trimmed $\frac{1}{2}$ inch wide flanged border of container 11 by placing the parts in the Vertrod impulse heat sealer and applying heat and pressure sufficient to provide a continuous seal between the flanged portion of container 11 and bottom wall 12. While the thickness selected for the bottom wall 12 of the exemplary package 13 can be widely varied, a thickness of ten (10) mils has been found to work well.

While particular embodiments of the present invention have been illustrated and described, it will be obvious to those skilled in the art that various changes and modifications can be made without departing from the spirit and scope of the present invention. It is intended to cover, in the appended claims, all such modifications that are within the scope of this invention.

What is claimed is:

1. A resiliently deformable package for dispensing deformable sheet products from a stack having a footprint, said package having an original shape and comprising:

a) a substantially planar bottom wall;

b) a thermoformed container of substantially rectangular shape, including:

i) a substantially planar top wall located in a plane which is remote from and substantially parallel to said substantially planar bottom wall;

ii) substantially continuous, flat but resiliently deformable side walls connected to said substantially planar top wall, said top wall being thicker and stiffer than said resiliently deformable side walls; and iii) flanged edges of said resiliently deformable side walls, said flanged edges sealed to said substantially planar bottom wall, said bottom wall being thicker and stiffer than said resiliently deformable side walls, said flat but resiliently deformable side walls self-restoring said package substantially to said original shape after being deformed under a compressive force; and c) a line of weakness for creating a dispensing aperture in said substantially planar top wall for dispensing said deformable sheet products one-at-a-time, said dispensing aperture being smaller than said footprint of said stack of resiliently deformable sheet products.

2. The resiliently deformable package of claim 1 further including a resealable label having an outermost border, said resealable label secured in superposed relation to said line of weakness, said resealable label being larger than said dispensing aperture so that said outermost border can reseal said dispensing aperture after the initial opening thereof.

3. The resiliently deformable package of claim 1 wherein said dispensing aperature is an ellipse, said ellipse having a major axis and a minor axis, said major axis being twice the length of said minor axis.

* * * * *